US011735855B2

(12) United States Patent
Sundarakrishnamachari et al.

(10) Patent No.: US 11,735,855 B2
(45) **Date of Patent: *Aug. 22, 2023**

(54) PRIMARY LOCKS WITH TERMINAL SERVICEABLITY FEATURES FOR MIXED CONNECTION COAXIAL CABLES

(71) Applicant: Aptiv Technologies Limited, St. Michael (BB)

(72) Inventors: Rangarajan Sundarakrishnamachari, Royapettah (IN); Sivakumar Jogula, Nagarkurnool (IN); Sudhakar Subramanian, Karur (IN); Abhaya Kishore, Nagercoil (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 17/859,167

(22) Filed: Jul. 7, 2022

(65) Prior Publication Data

US 2022/0344857 A1 Oct. 27, 2022

Related U.S. Application Data

(63) Continuation of application No. 17/060,806, filed on Oct. 1, 2020, now Pat. No. 11,394,151.

(51) Int. Cl.
*H01R 13/40* (2006.01)
*H01R 13/424* (2006.01)
(Continued)

(52) U.S. Cl.
CPC ..... *H01R 13/424* (2013.01); *H01R 27/02* (2013.01); *H01R 43/00* (2013.01);
(Continued)

(58) Field of Classification Search
CPC ..... H01R 13/424; H01R 13/42; H01R 13/40; H01R 13/5208; H01R 13/5202;
(Continued)

(56) References Cited

U.S. PATENT DOCUMENTS 4,046,451 A 9/1977 Juds et al.
4,340,265 A 7/1982 Ott et al.
(Continued)

FOREIGN PATENT DOCUMENTS

CN 101960673 B 1/2013
GB 2518777 A 4/2015
WO 2004055948 A1 7/2004

OTHER PUBLICATIONS

Extended European Search Report Received dated Feb. 21, 2022, 11 pages.

(Continued)

*Primary Examiner* — Harshad C Patel
(74) *Attorney, Agent, or Firm* — Billion & Armitage

(57) ABSTRACT

A connector apparatus including a housing, and a primary lock reinforcement. The housing includes at least one substantially cylindrical coaxial cavity therein. The coaxial cavity has a first end, a second end, and a locking finger. At least one stop is located proximate the second end. A locking finger is positioned intermediate the first end and the second end. The locking finger includes a locking tab, and an unlocking surface. The locking finger is formed to be flexible and capable of flexing between a lock position and an unlock position. The locking finger is biased toward the lock position. The primary lock reinforcement is placed in the housing and has an opening therein corresponding to the second end of the cylindrical coaxial cavity.

20 Claims, 11 Drawing Sheets

(51) Int. Cl.

| | |
|---|---|
| ***H01R 27/02*** | (2006.01) |
| ***H01R 43/00*** | (2006.01) |
| *H01R 13/52* | (2006.01) |
| *H01R 13/58* | (2006.01) |
| *H01R 13/631* | (2006.01) |

(52) U.S. Cl.
CPC ..... *H01R 13/5202* (2013.01); *H01R 13/5208* (2013.01); *H01R 13/582* (2013.01); *H01R 13/631* (2013.01)

(58) Field of Classification Search
CPC ..... H01R 13/52; H01R 13/46; H01R 13/582; H01R 13/631; H01R 13/56; H01R 13/629; H01R 13/62; H01R 27/02; H01R 43/00
USPC ..... 439/578
See application file for complete search history.

(56) References Cited

U.S. PATENT DOCUMENTS

| | | | | |
|---|---|---|---|---|
| 4,580,865 | A | 4/1986 | Fryberger | |
| 5,211,589 | A | 5/1993 | McCardell | |
| 5,295,875 | A | 3/1994 | McCardell | |
| 5,859,534 | A * | 1/1999 | Saijo | H01R 13/424 439/595 |
| 5,906,511 | A | 5/1999 | Bozzer et al. | |
| 7,029,328 | B1 | 4/2006 | Mckenzie et al. | |
| 7,470,157 | B2 | 12/2008 | Hiramatsu | |
| 7,544,081 | B2 | 6/2009 | Lim | |
| 7,628,654 | B2 | 12/2009 | Hori et al. | |
| 8,348,689 | B2 * | 1/2013 | Shibata | H01R 13/6215 439/271 |
| 8,465,313 | B2 * | 6/2013 | Shibata | H01R 13/5202 439/271 |
| 9,106,000 | B2 * | 8/2015 | Mizutani | H01R 13/5219 |
| 9,484,667 | B2 | 11/2016 | Ichio | |
| 9,673,563 | B2 | 6/2017 | Kataoka | |
| 9,899,758 | B1 | 2/2018 | Morello et al. | |
| 10,498,066 | B1 | 12/2019 | Sundarakrishnamachari et al. | |
| 11,394,151 | B2 * | 7/2022 | Sundarakrishnamachari | H01R 13/424 |
| 2009/0163075 | A1 | 6/2009 | Blew et al. | |
| 2011/0053403 | A1 | 3/2011 | Tsuruta et al. | |
| 2015/0295357 | A1 | 10/2015 | Campbell et al. | |
| 2021/0013662 | A1 | 1/2021 | Probert et al. | |

OTHER PUBLICATIONS

"Communication pursuant to Article 94(3) EPC Received dated Jun. 22, 2023", 7 Pages.

* cited by examiner

PRIMARY LOCKS WITH TERMINAL SERVICEABLITY FEATURES FOR MIXED CONNECTION COAXIAL CABLES

CROSS-REFERENCE TO RELATED APPLICATION

This application is a continuation application of U.S. patent application Ser. No. 17/060,806, filed Oct. 1, 2020, the entire disclosure of each of which is hereby incorporated by reference.

FIELD

This disclosure is generally directed to a sealed connector system that includes a multi pin lay out and a coaxial cavity. More specifically, it relates to primary locks with terminal serviceability features for mixed connection coaxial cables.

BACKGROUND

Coaxial connectors are widely used in the automotive industry to transmit high speed signals between systems and subsystems in an automobile. Other types of vehicles also use coaxial cables in the same manner. As vehicles continue to become "smarter" the use of coaxial cables in vehicles is bound to increase dramatically in the future.

FIGS. 1-3 illustrate a conventional coaxial connector 100 having a male connector 101 (shown in FIG. 3) and a female connector 102 (shown in FIG. 2) as known in the prior art. An exploded view of a conventional female connector is shown in FIG. 2 and includes an outer housing assembly 120, an inner housing 140, a terminal assembly 200, a stuffer 110, and seal retainer 130. The outer housing assembly 120 contains connector locking features. The TPA stuffer 110 contains primary lock features 112 and includes provisions for a wire seal and interface seal 114. The seal retainer 130 supports the stuffer 110 and wire/interface seal 114. The inner housing 140 includes a primary lock reinforcing features and lock features for the stuffer 110 and the seal retainer 130.

An exploded view of a conventional male connector is shown in FIG. 3 and likewise includes a retainer 130', a stuffer TPA 110', a terminal assembly with wire seal 200', and an inner housing assembly with seal 140'. The TPA stuffer 110' once again includes contains primary lock features 112'. The inner housing 140' includes a primary lock reinforcing features and lock features for the stuffer TPA 110' and the seal retainer 130'.

With respect to the female connector 102, the assembly sequence is designed in such a way that the outer housing assembly 120 and inner housing 140 is assembled together first. The stuffer TPA 110 with an interface seal 114 is then inserted from wire exit side of the inner housing 140 to keep it in a pre-lock position. The terminal assembly 200 with wire seal is then inserted into the assembly which is locked by the primary lock features 112 integrated with the stuffer 110. The stuffer 110 is now pushed further in an axial mating direction inside the inner connector assembly 120 and outer connector assembly 140 until it reaches the final lock position. The reinforcing ribs on the inner housing 140 provide support for the primary lock features 112 on the stuffer 110 and protects it from any failures caused during connector assembly engagement. The seal retainer 130 is assembled to provide support for the wire seal. It also supports the stuffer 110 being pushed from final lock to pre-lock due to high forces exerted during connector assembly engagement. The male connector 101 shown in FIG. 3 is assembled in a similar fashion.

The current arrangement and assembly, described above, has many deficiencies or disadvantages. Included among the deficiencies or disadvantages, is the fact that the stuffer 110 and the interface seal 114 are added components used to seal and protect the terminal cavity from water penetration. These extra components add to the cost of manufacture and also increase the assembly cycle time. Additionally, when the terminal needs servicing, the entire stuffer assembly must be removed after removal of the seal retainer. The result is an increased amount of time and complexity during terminal service. Yet another disadvantage is that conventional type coaxial cavities cannot be combined with a multi pin layout connection.

SUMMARY

A connector apparatus includes a housing, and a primary lock reinforcement. The housing includes at least one substantially cylindrical coaxial cavity therein. The coaxial cavity has a first end, a second end, and a locking finger. At least one stop is located proximate the second end. A locking finger is positioned intermediate the first end and the second end. The locking finger includes a locking tab, and an unlocking surface. The locking finger is formed to be flexible and capable of flexing between a lock position and an unlock position. The locking finger is biased toward the lock position. The primary lock reinforcement is placed in the housing and has an opening therein corresponding to the second end of the cylindrical coaxial cavity.

In one embodiment, the coaxial cavity includes a tubular section, and the locking finger formed from the sidewall of the tubular section. The tubular section has a first pair of substantially parallel slits in the sidewall which are substantially parallel to an axis of the at least one substantially cylindrical coaxial cavity. The tubular section also has a second pair of substantially parallel slits in the sidewall which are substantially parallel to an axis of the at least one substantially cylindrical coaxial cavity and collinear with the first pair of slits. A major portion of the locking finger is formed between the first pair of slits and the second pair of slits. The distance between the first pair of slits and the second pair of slits in the sidewall acts as a pivot area for the locking finger, in one embodiment. In another embodiment, the unlocking surface includes an unlocking channel. The unlocking channel is inclined with respect to the outer surface of the tubular portion of coaxial cavity in the housing. The primary lock reinforcement includes a guide channel aligned with the unlocking channel on the locking finger. The primary lock reinforcement also includes an opening on a connector side of the primary lock reinforcement corresponding to the guide channel. The guide channel and the unlocking channel are sized to receive an elongated unlocking tool. In another embodiment, there is another locking finger. In other words, there are two locking fingers. The two locking fingers are formed on opposite sides of the coaxial cavity. The coaxial cavity also has a sealing surface is formed near the first end of the coaxial cavity. In still another embodiment, the connector apparatus has a second coaxial cavity. In still a further embodiment, the connector apparatus includes a plurality of elements for connecting other types of electrical contacts. The primary lock reinforcement further includes a first connector surface, and a second interior surface which includes an alignment scoop to engage corresponding features in the housing. In one embodiment the connector is a female connector, and in another embodiment the connector is a male connector.

A connector assembly includes a housing having at least one substantially cylindrical coaxial cavity therein, the coaxial cavity further includes a first end, and a second end. The cylindrical coaxial cavity has at least one stop located proximate the second end. The cylindrical coaxial cavity also has a first locking finger intermediate the first end and the second end, and a second locking finger intermediate the first end and the second end. The second locking finger is on the opposite side of the coaxial cavity from the first locking finger. Both the first locking finger and the second locking finger also include a locking tab, and an unlocking surface. The locking finger is formed to be flexible and capable of flexing between a lock position and an unlock position. The locking finger biased toward the lock position. The connector assembly also includes a coaxial cable including a terminal end. The terminal end includes an end that abuts the stop at the second end of the coaxial cavity, and a locking rib for engaging the locking tab of the locking finger. The connector assembly also includes a primary lock reinforcement, which is placed in the housing. The primary lock reinforcement has an opening therein corresponding to the second end of the cylindrical coaxial cavity. The unlocking surface on the flexible locking finger includes an annular unlocking channel. The primary lock reinforcement includes a connector side, and an interior side. The interior side includes annular guide channels which align to the annular unlocking channel on the locking tab. The unlocking channel is inclined toward the coax terminal from the second end of the cylindrical coaxial cavity. The connector assembly can also include a coax removal tool having a first elongated prong and a second elongated prong. The connector side includes a first opening for the first annular guide channel, and a second opening for the second annular guide channel. The first prong and the second prong are inserted each prong travels down the annular guide channel to the annular unlocking channel in each of the flexible locking fingers to disengage the locking tabs from the locking rib on the coax terminal which releases the coax from the cylindrical coaxial cavity.

DESCRIPTION OF THE DRAWINGS

The invention is pointed out with particularity in the appended claims. However, a more complete understanding of the present invention may be derived by referring to the detailed description when considered in connection with the figures wherein like reference numbers numerals refer to similar items throughout the figures.

DETAILED DESCRIPTION

Figure 1:
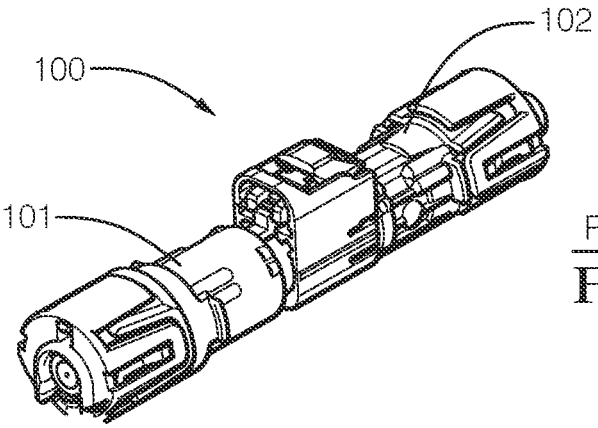
PRIOR ART FIG. 1
FIG. 1 is an isometric view of a conventional coaxial assembly in which the male connector is connected to the female connector as known in the prior art.
Figure 2:
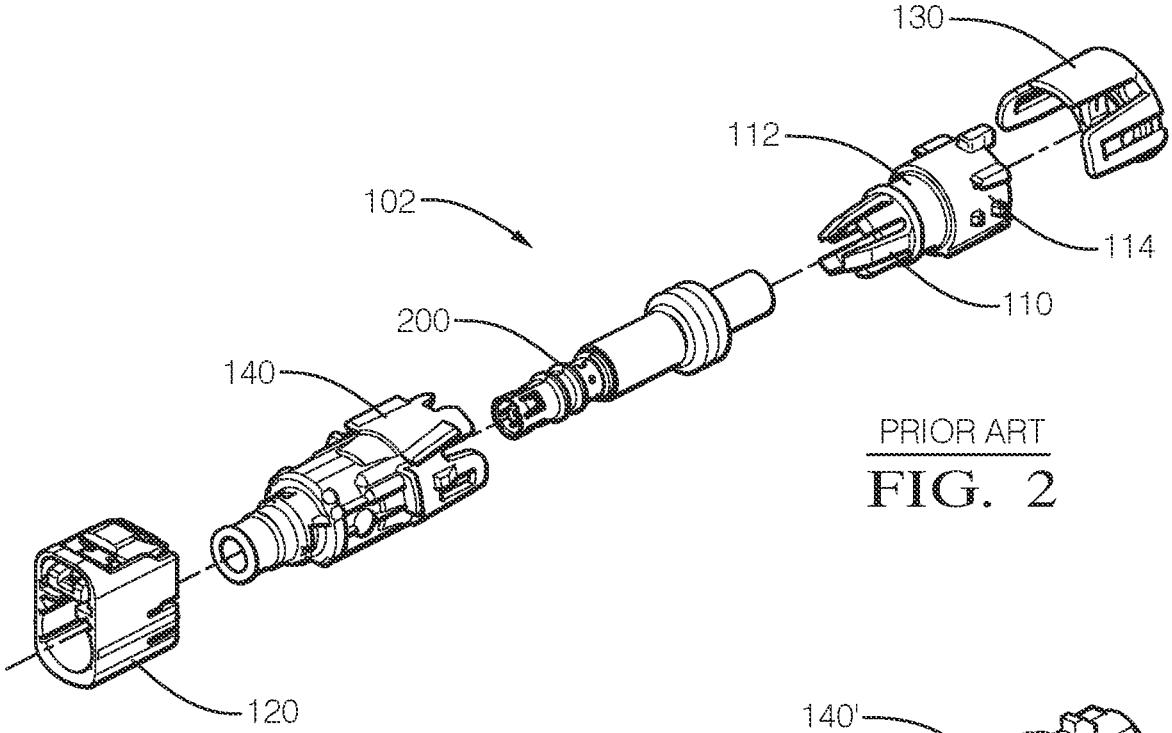
PRIOR ART FIG. 2
FIG. 2 is an exploded isometric view of a female connector of a conventional coaxial assembly as known in the prior art.
Figure 3:
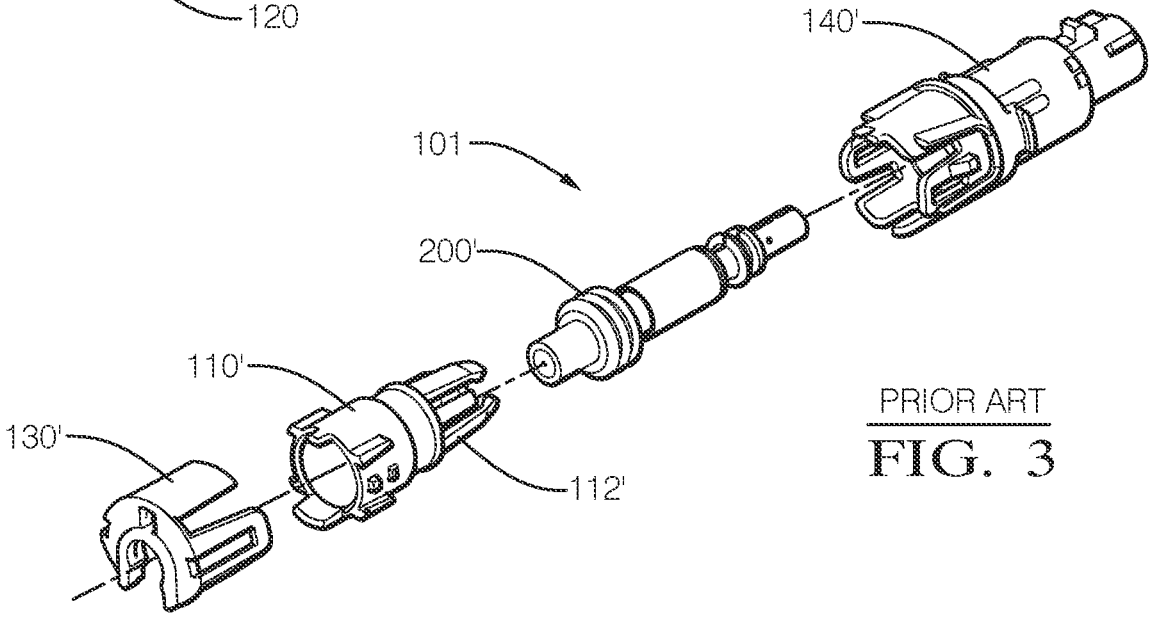
PRIOR ART FIG. 3
FIG. 3 is an exploded isometric view of a male connector of a conventional coaxial assembly as known in the prior art.

The description set out herein illustrates the various embodiments of the invention and such description is not intended to be construed as limiting in any manner. FIGS. 1-3 are discussed above with respect to the background of the invention. Now starting with FIG. 4, various embodiments of the invention will now be discussed and further detailed.

Figure 4A:
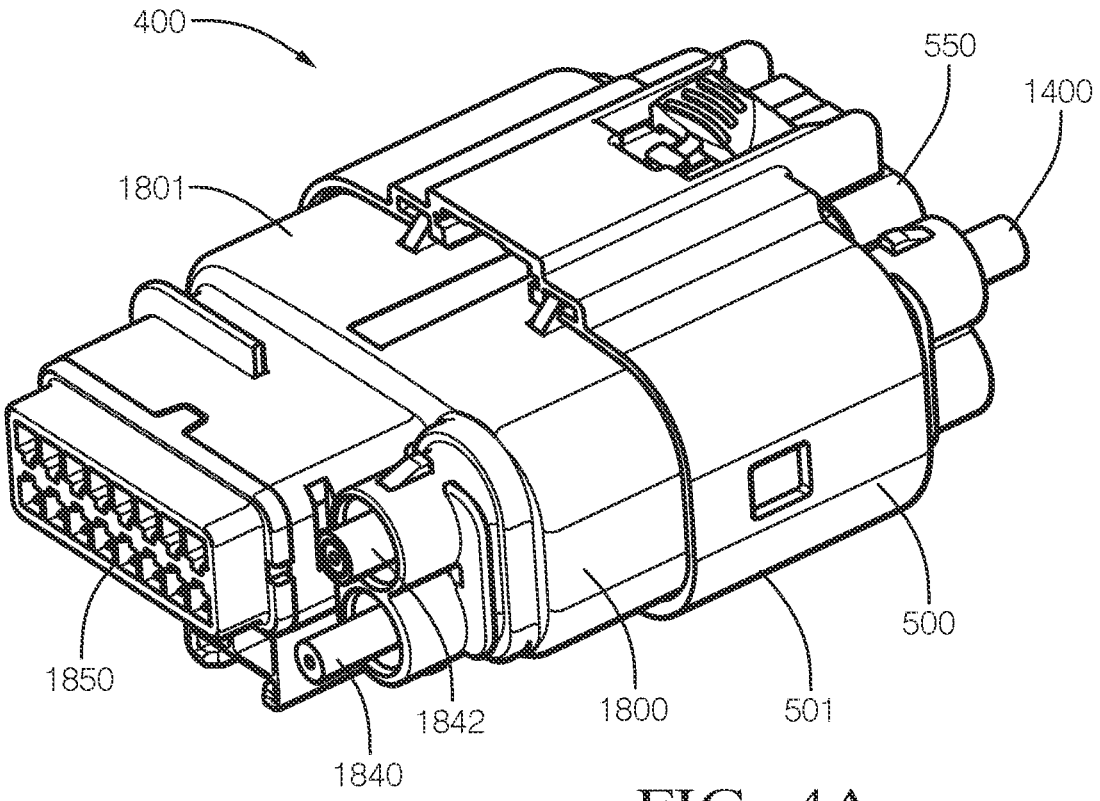
FIGS. 4A and 4B are front and rear isometric views of an inline connector system that includes coaxial cavities combined with a multi pin layout connection, according to some embodiments.
Figure 4B:
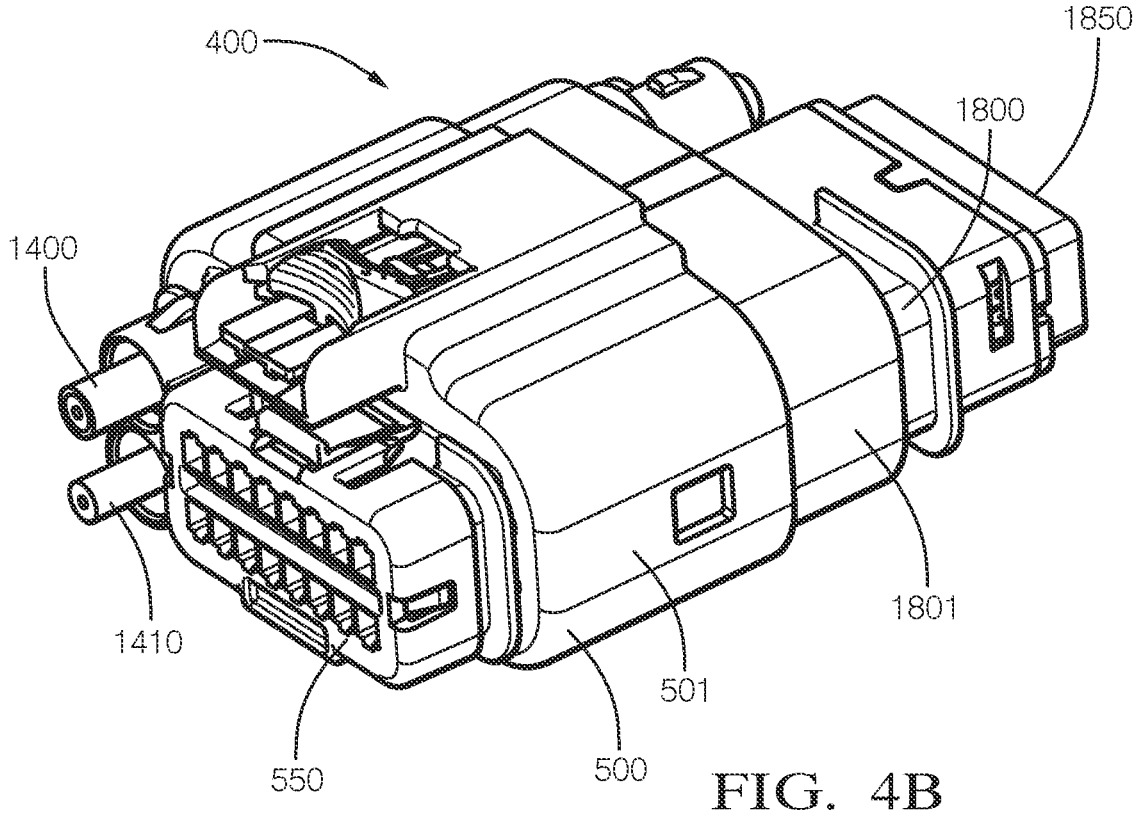

FIG. 4 is an isometric view of a connector assembly 400 that includes a male connector 1800 ad female connector 500. The connector assembly 400 is utilized to connect a multi pin terminals as well as one or more coaxial terminals. The male connector 1800 includes a male housing 1801. Male multi pin terminals 1812 and a pair of male coaxial terminals 1840 and 1842 protrude from the housing (shown in more detail in FIG. 18). The female connector 500 also has a female housing 501. The female connector 500 includes coaxial terminals 1400, 1410 configured to engage with the male coaxial terminals 1840 as well as multi pin connectors, 510, 512 configured to engage with the male multi pin terminals 1812. The female connector 500 includes coaxial cavities 620, 622 (shown in FIGS. 5-10) for receiving the coaxial terminals 14001410, respectively, according to some embodiments. The female connector 500 will be further detailed in the following FIGS. 5 through 17. As shown in FIG. 4, the female connector 500 is connected to the male connector 1800. FIG. 4 shows the connected members as a front perspective view and a rear perspective view.

Figure 18:
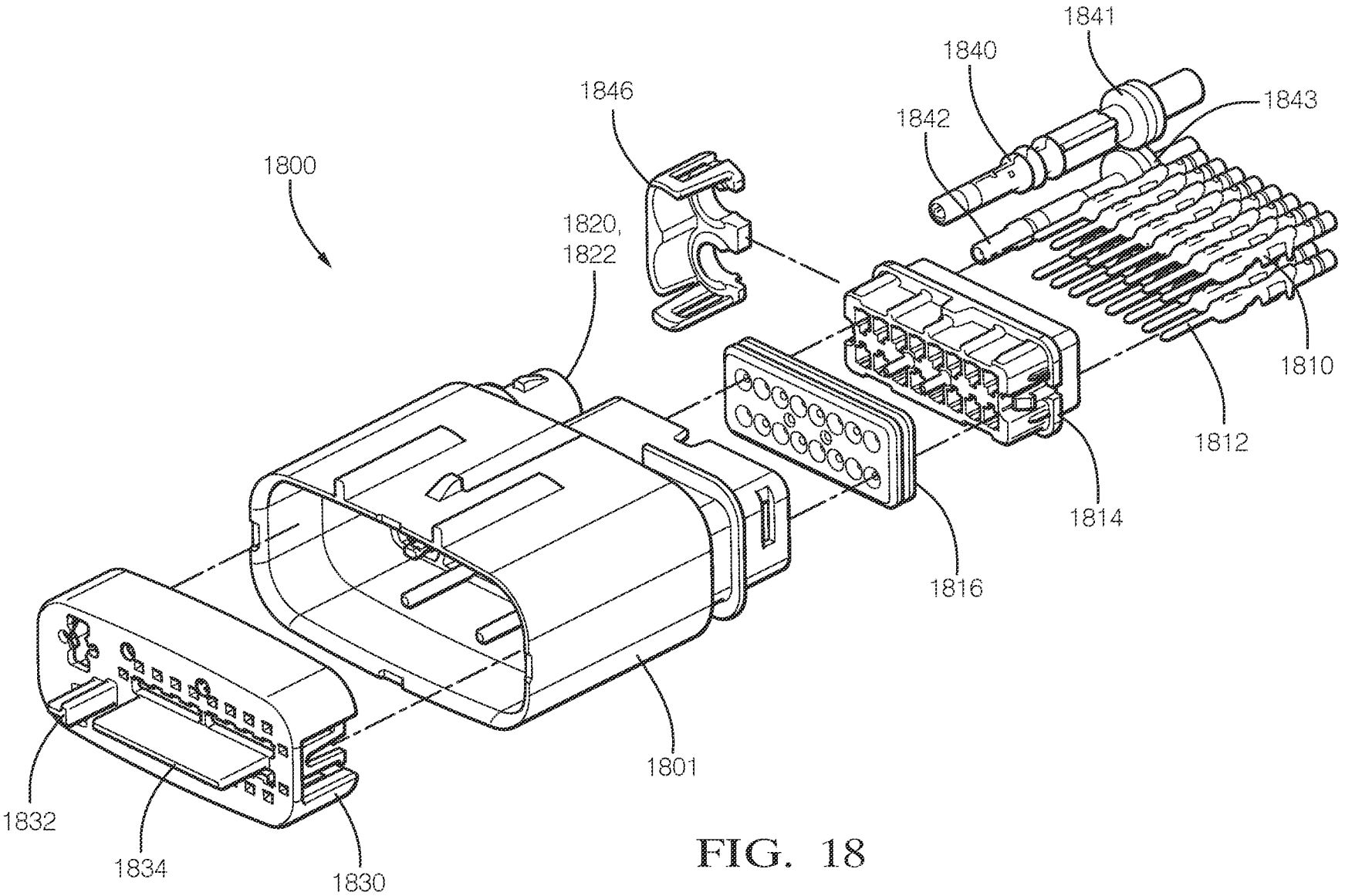
FIG. 18 is exploded isometric view of the male connectors of a connector assembly that includes coaxial cavities combined with a multi pin layout connection, according to some embodiments.

FIG. 18 is exploded isometric view of the male connector 1800 of the connector assembly 400 that includes coaxial cavities 1820, 1822 combined with a multi pin layout connection 1810, according to an example embodiment. The multi pin layout connection 1810 includes multiple pins or male multi pin terminals 1812, a strain relief 1814 a mat seal 1816, a male housing 1801, and a primary lock reinforcement 1830. The primary lock reinforcement 1830 is also known as the PLR. The PLR 1830 includes a first scoop tab 1832 and a second elongated scoop tab 1834. The first scoop tab 1832 is aligned with corresponding cavity 1132 in the PLR 1100 in the female connector 500 (see FIG. 11). The second elongated scoop tab 1834 is aligned with corresponding cavity 1134 in the PLR 1100 in the female connector 500 (see FIG. 11). The first scoop tab 1832 and a second elongated scoop tab 1834 align the various components such as the male multi pin terminals 1812 with the female counterparts, namely multi pin connectors 510, 512 as well as the coaxial terminals 1840 (located on the male connector 1800) with the female counterparts, namely coaxial terminals 1400, 1410. The male housing 1801 includes cavities 1820, 1822 for receiving the coaxial terminals 1840 of two coaxial cables.

The cavities 1820, 1822 are within the male housing 1801. Each of the coaxial cables is provided with a coaxial terminal 1840, 1842, respectively. The coaxial terminals 1840, 1842 also include a corresponding set of seals 1841 and 1843. The seals 1841, 1843 provide ingress protection and moisture resistance for the male connector 1800. The coaxial terminals 1840, 1842 also include coaxial ribs or seats that can catch features within the coaxial cavities 1820, 1822. A coaxial cavity seal retainer 1846 is also provided. The coaxial cavity seal retainer holds the coaxial terminal seals 11841, 1843 within the cavities 1820, 1822 and further seals the male connector to prevent the introduction of moisture or other contaminants. The male multi pin terminals 1812 extend through the mat seal 1816 and the strain relief 1814 as well as through the PLR 1830. The coaxial terminals 1840, 1842 extend into the cavities 1820, 1822 of the male housing 1801 and terminate near the PLR 1830. The coaxial cavity seal retainer 1846 is added to the male housing or mated to the male housing to provide strain relief for the coaxial terminals 1840, 1842 and to further seal them from moisture or other elements such as dust. It should be noted that the cavities 1820, 1822 of the male housing 1801 are not detailed here. Of note is that the coaxial cavities 1820, 1822 have many of the same features as the female cavities which will be discussed below with respect to FIGS. 5 to 17. Rather than discuss the same features twice, the features will be further detailed with respect to the female connectors with the understanding that the male connectors have many of the same features.

Figure 5:
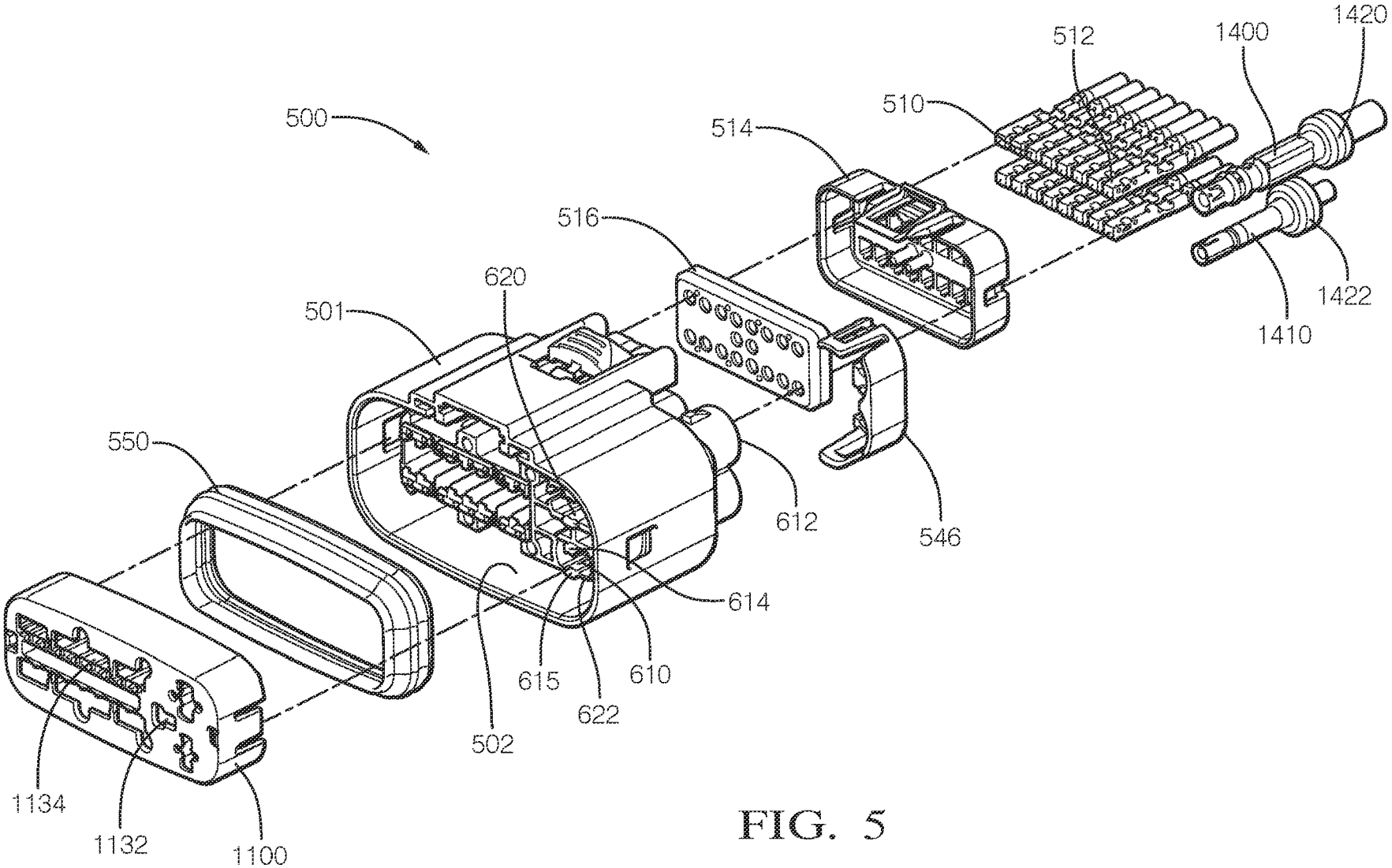
FIG. 5 is exploded isometric view of the female connector of a connector assembly that includes coaxial cavities combined with a multi pin layout connection, according to some embodiments.

FIG. 5 is exploded isometric view of the female connector 500 of a connector assembly that includes coaxial cavities 620, 622 combined with a multi pin connectors 510, 512 according to an example embodiment. More specifically, the multi pin connectors 510, 512 are female receptacles for receiving male pins from the male connector 1800. The female connector 500 and the male connector 1800 can generally be termed as connector apparatus. The female connector 500 includes a female housing 501, a primary lock reinforcement 1100, and interface seal 550, a mat seal 516, a strain relief 514, and a coaxial cavity seal retainer 546. The female housing 501 also includes the coaxial cavities 620, 622. The female housing 501 includes an end 502 for connecting to the male connector 1800. The primary lock reinforcement 1100 and the interface seal 550 are connected to end 502. The female housing 501 includes at least one substantially cylindrical coaxial cavity therein. As shown in this embodiment, the female housing 501 includes two cylindrical coaxial cavities 620, 622. Also connected to the other end of the female housing 501 is the mat seal 516, the coaxial cavity seal retainer 546, and the strain relief 514. The coaxial cavity seal retainer 546 holds and seals the terminal cable ends or coaxial terminals 1400, 1410 with respect to the female housing 501. The multi pin connector portion which includes a plurality of female ends of the multi pin connectors 510, 512 is positioned within the female housing 501. The multi pin connectors 510, 512 pass through the mat seal 516 and the strain relief 514. The strain relief 514 prevents or lessons strain on the multi pin connectors 510, 512.

FIG. 5 also shows some of the features of the coaxial cavities 620, 622. The coaxial cavities 620, 622 will be discussed in more detail below. Visible in FIG. 5 is the coaxial cavity, such as coaxial cavity 620. Coaxial cavity 620 has a first end 610, and a second end 612. The second end 612 includes stops 614, 615.

Figure 6:
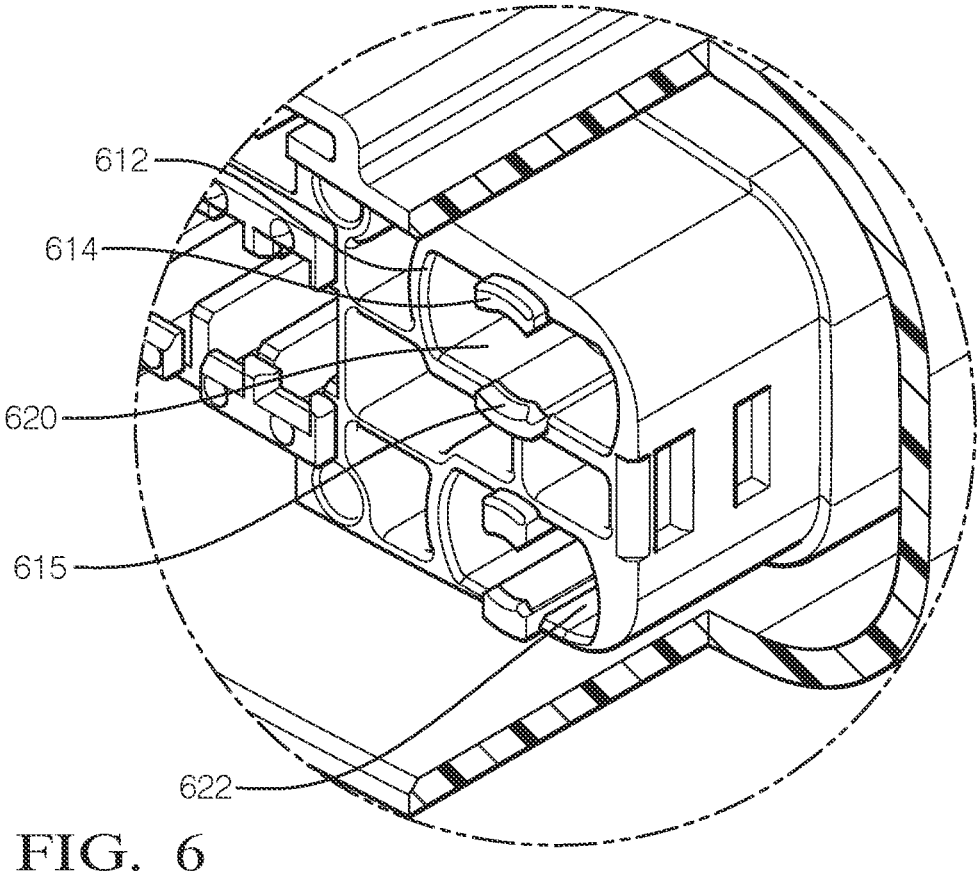
FIG. 6 is an isometric view of the housing of the female connector of a connector assembly that shows the coaxial cavities, according to an example embodiment.
Figure 7:
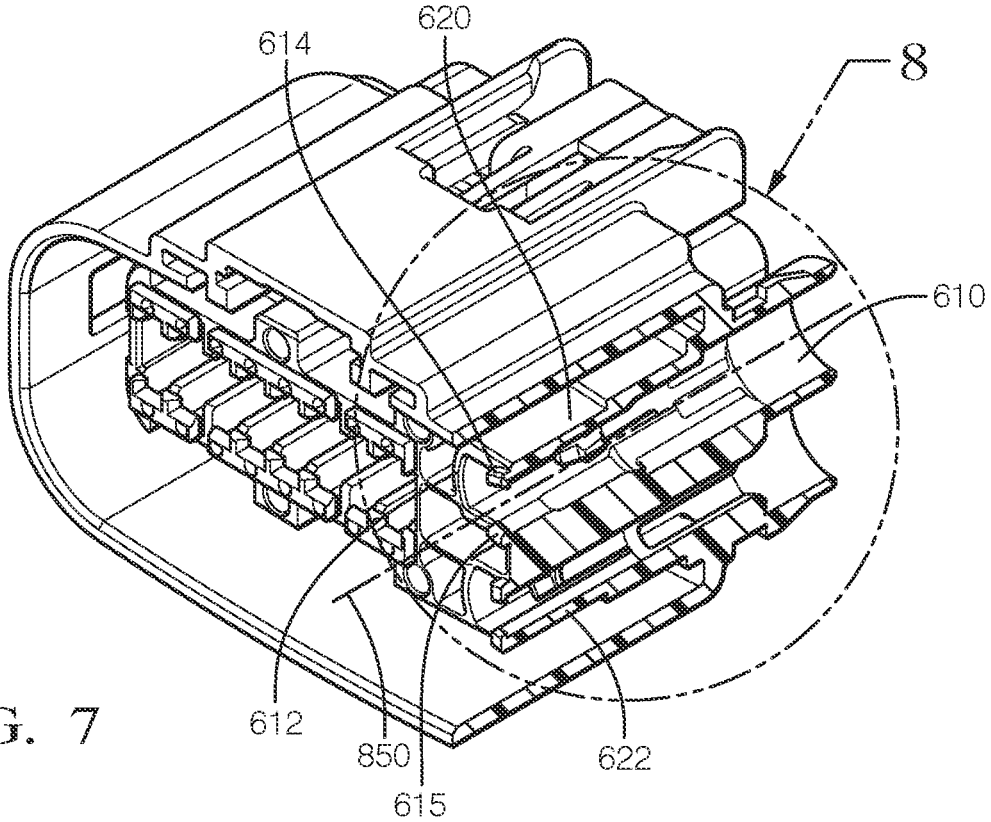
FIG. 7 is a front isometric cutaway view of the housing of the female connector of a connector assembly that includes coaxial cavities combined with a multi pin layout connection, according to some embodiments.
Figure 8:
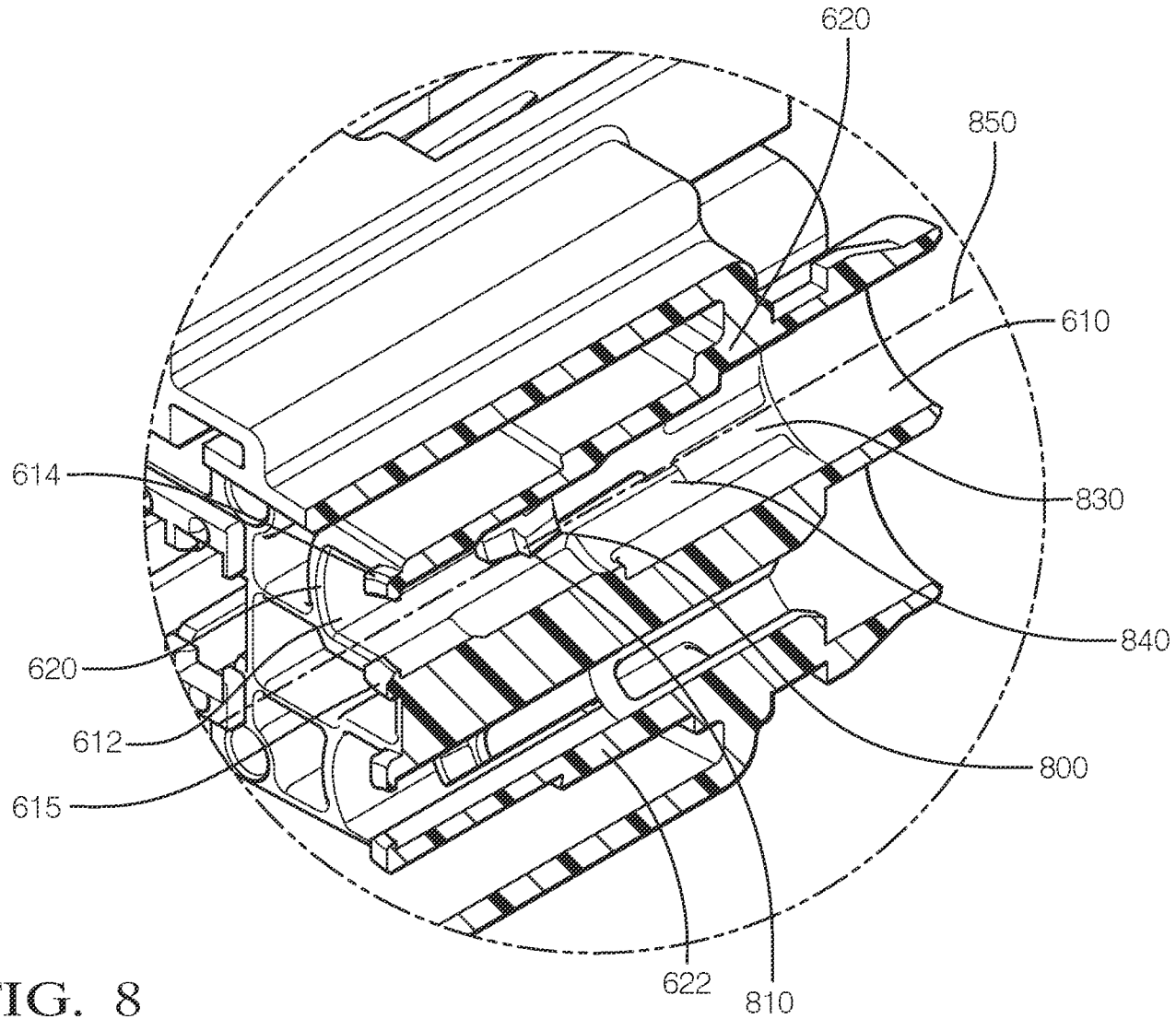
FIG. 8 is close-up isometric cutaway view of the housing of the female connector of a connector assembly shown in FIG. 7 that shows further detail of the coaxial cavities, according to an example embodiment.
Figure 9:
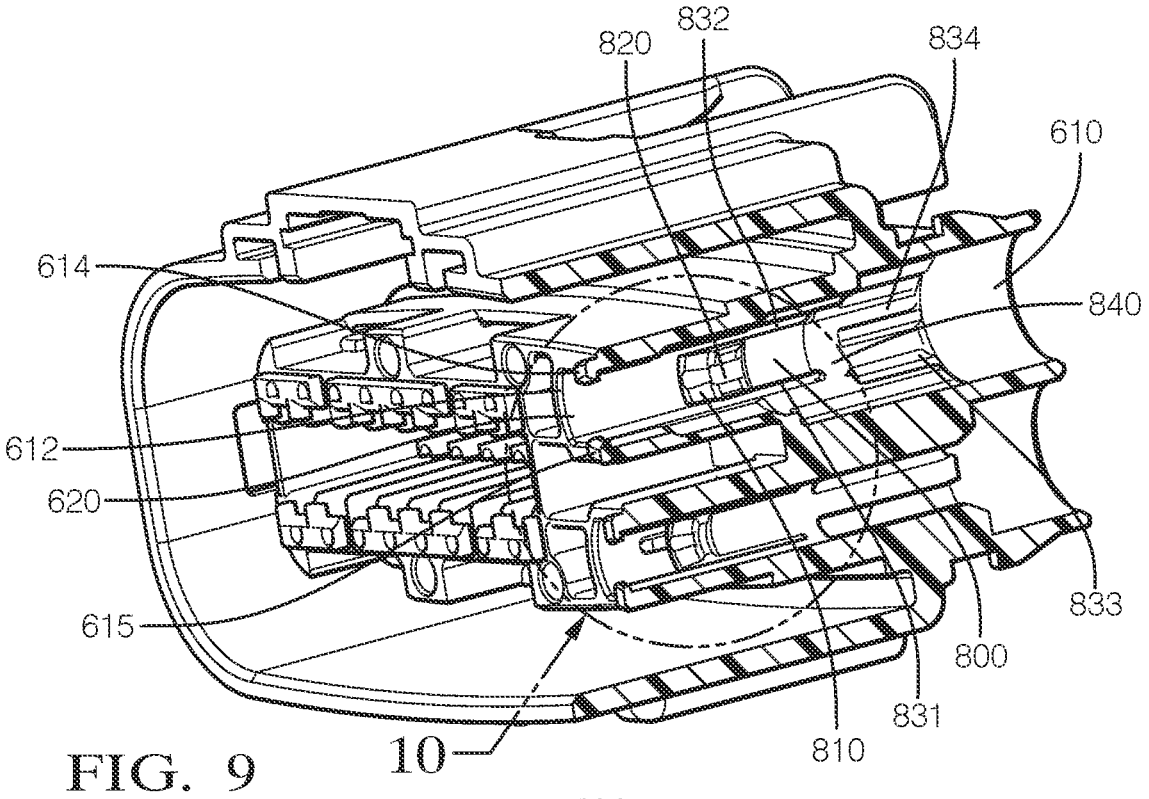
FIG. 9 is an isometric cutaway view of the housing of the female connector of a connector assembly that shows one portion of the locking feature of the coaxial cavities, according to some embodiments.
Figure 10:
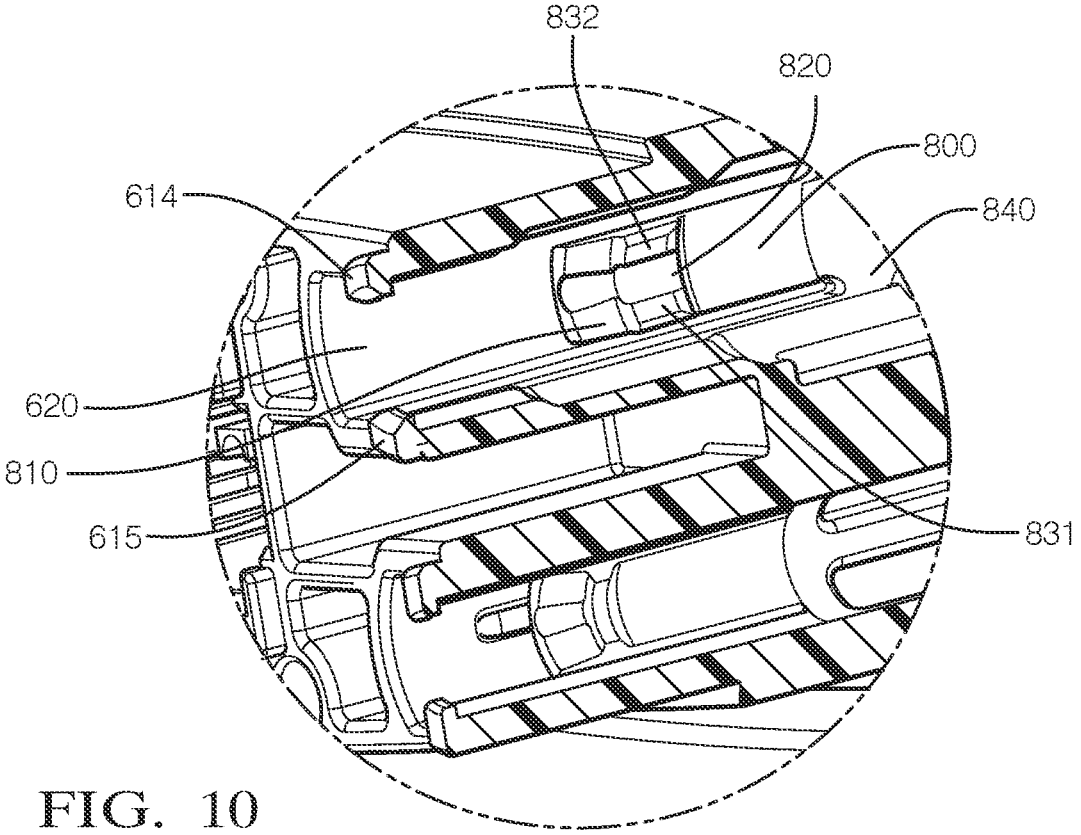
FIG. 10 is close-up isometric cutaway view of the housing of the female connector of a connector assembly shown in FIG. 9 that shows further detail of the locking feature of the coaxial cavities, according to some embodiments.

Now referring to FIGS. 6, 7, 8, 9 and 10, the coaxial cavities will be further detailed. FIG. 6 is a front isometric cutaway view of the housing of the female connector of a connector assembly that includes coaxial cavities combined with a multi pin layout connection, according to an example embodiment. FIG. 7 is an isometric cutaway view of the housing of the female connector of a connector assembly that shows the coaxial cavities, according to an example embodiment. FIG. 8 is close-up isometric cutaway view of the housing of the female connector of a connector assembly shown in FIG. 7 that shows further detail of the coaxial cavities, according to an example embodiment. FIG. 9 is an isometric cutaway view of the housing of the female connector of a connector assembly that shows one portion of the locking feature of the coaxial cavities, according to an example embodiment. FIG. 10 is close-up isometric cutaway view of the housing of the female connector of a connector assembly shown in FIG. 9 that shows further detail of the locking feature of the coaxial cavities, according to an example embodiment.

Each of the coaxial cavities 620, 622 is substantially the same. Therefore, for the sake of brevity, coaxial cavity 620 will be discussed with the understanding that coaxial cavity 622 has the same features or substantially the same features. The coaxial cavity 620 has a first end 610, a second end 612, and a locking finger 800. At least one stop 614, 615 is located proximate the second end 612. The locking finger 800 is positioned intermediate the first end 610 and the second end 612. The locking finger 800 is formed along the side wall of the coaxial cavity 620. The coaxial cavity includes a thin wall.

The locking finger 800 includes a locking tab 810. The locking tab also includes an unlocking surface 820. This is most easily seen in FIG. 10. The locking finger 800 is formed to be flexible and capable of flexing between a lock position and an unlock position. The locking finger 800 is biased toward the lock position. Put another way, the locking finger 800 is biased inwardly or toward a central axis of the coaxial cavity 620

In one embodiment shown in FIGS. 6 through 10, the coaxial cavity 620 includes a thin walled, tubular section. At least a portion of the locking finger 800 formed from the sidewall 830 of the tubular section. The tubular section has a first pair of substantially parallel slits 831, 832 in the sidewall 830 which are substantially parallel to an axis 850 of the at least one substantially cylindrical coaxial cavity 620. The tubular section also has a second pair of substantially parallel slits 833, 834 in the sidewall 830 which are substantially parallel to the axis 850 of the at least one substantially cylindrical coaxial cavity 620. The first pair of slits 831, 832 is substantially collinear with the second pair of slits 833, 834. A major portion of the locking finger is formed between the first pair of slits 831, 832 and the second pair of slits 833, 834. The distance between the first pair of slits 831, 832 and the second pair of slits 833, 834 in the sidewall 830 acts as a pivot area 840 for the locking finger 800. In other words, the pivot area 840 is a flexible area about which the locking finger 800 rotates. The pivot area 840 also biases the locking finger 800 toward the inner portion of the cylindrical coaxial cavity 620. Put another way, the pivot area 840 biases the locking finger 800 toward the axis 850 of the cylindrical coaxial cavity 620. The pivot area 840 is a flexible portion about which the locking finger 800 pivots. It is not a true pivot but is more akin to a pivot with a spring biasing it toward the axis 850 of the cylindrical coaxial cavity 620.

As mentioned earlier, the locking finger 800 also includes the unlocking surface 820. The unlocking surface 820 includes an unlocking channel 822. The unlocking channel is inclined with respect to the outer surface of the sidewall 830 the cylindrical coaxial cavity 620 in the female housing 501. The unlocking channel 822 is most distant from the axis 850 near the second end of the coaxial cavity 620. Even more particularly, the locking finger 800 has a free end. At the free end of the locking finger 800 the unlocking channel 822 is most distant from the axis 850. The unlocking channel 822 is semicircular in cross-section.

Figure 11A:
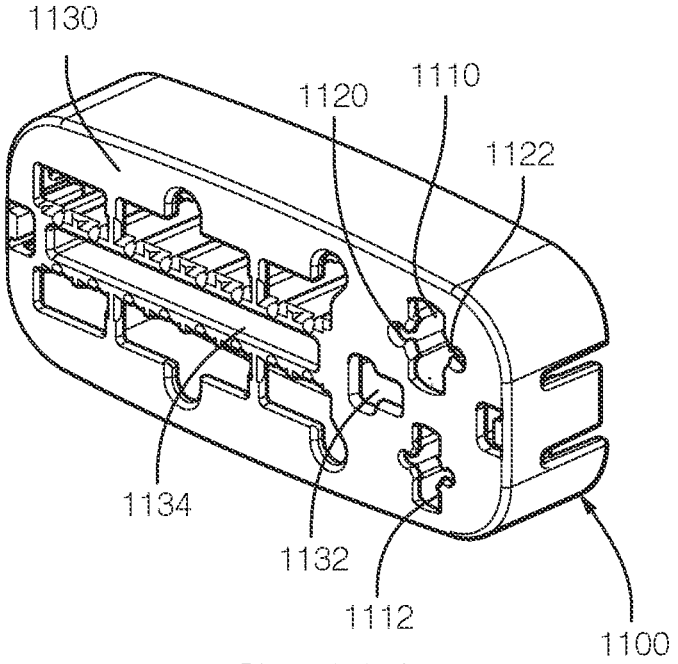
FIGS. 11A and 11B are front and rear isometric views of the primary lock reinforcement ("PLR") of the female connector of a connector assembly, according to some embodiments.
Figure 11B:
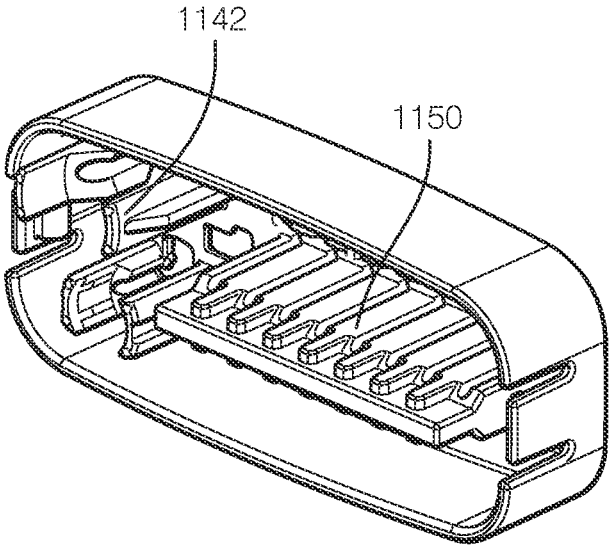
Figure 12:
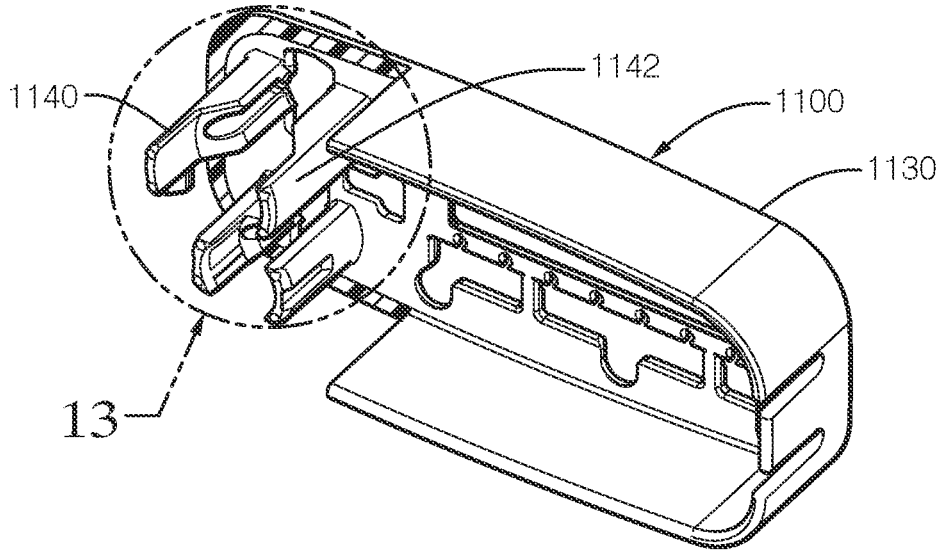
FIG. 12 is a rear isometric view of the PLR of the female connector of a connector assembly, according to some embodiments.
Figure 13:
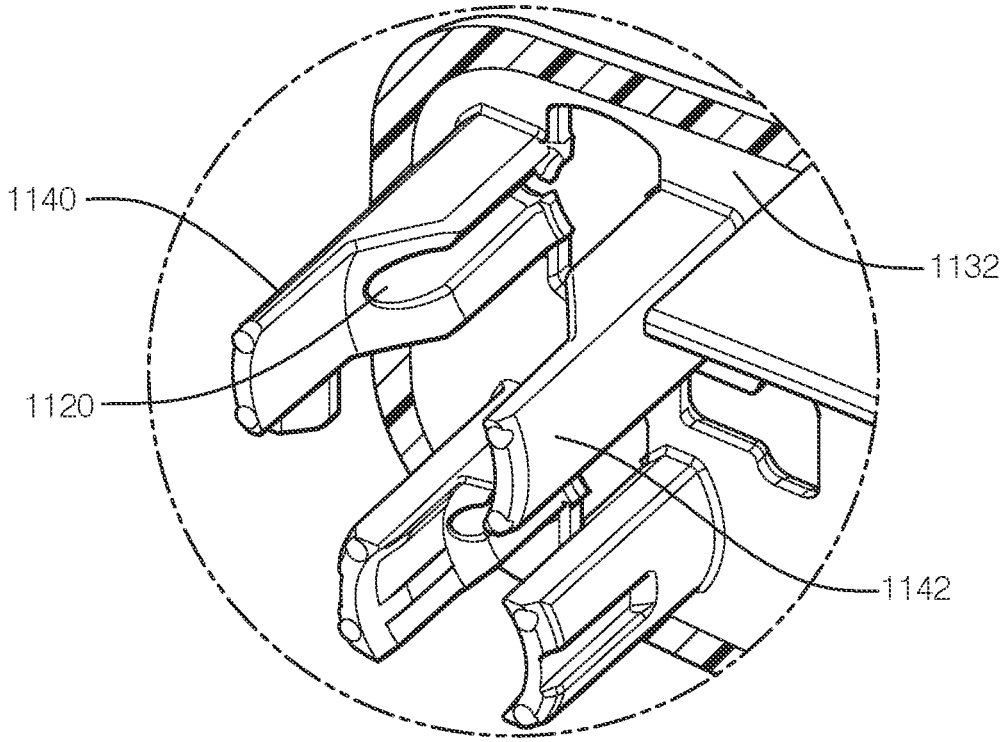
FIG. 13 is a close-up rear isometric view of the PLR of the female connector of a connector assembly shown in FIG. 12, according to an example embodiment.

FIG. 11 is a front isometric view of the primary lock reinforcement ("PLR") 1100 of the female connector of a connector assembly, according to an example embodiment. FIG. 12 is a rear isometric view of the PLR 1100 of the female connector of a connector assembly, according to an example embodiment. FIG. 13 is a close-up rear isometric view of the PLR of the female connector of a connector assembly shown in FIG. 12, according to an example embodiment. The PLR 1100 will now be discussed in further detail with respect to the FIGS. 11, 12 and 13. The PLR 1100 includes openings for the multiple pin connector area and the coaxial cable terminals. In other words, the PLR includes openings which allow the ends of the various connections to be accessed.

The primary lock reinforcement 1100 includes openings 1110, 1112 for the coaxial cavities 620, 622. Each of the openings 1110, 1112 is substantially the same. Therefore, for the sake of brevity, opening 1110 to the coaxial cavity 620 will be discussed with the idea that the opening 1112 to the coaxial cavity 622 has the same features or substantially the same features.

The primary lock reinforcement 1100 includes a guide channel 1120, 1122 aligned with the unlocking channel or unlocking surface 820 on the locking finger 800. The primary lock reinforcement 1100 also includes an opening on a connector side 1130 of the primary lock reinforcement 1100 corresponding to the guide channel. The guide channel 1120, 1122 and the unlocking channel 822, and an unlocking channel not shown for coaxial cavity 620, are sized to receive an elongated unlocking tool 1600 (shown in FIGS. 16 and 17). As discussed above, the coaxial cavity 620 has two locking fingers which are formed on opposite sides of the coaxial cavity 620. As a result, the PLR 1100 and more specifically the guide channels 1120, 1122 oppose one another so as to align with the unlocking surfaces 820 of the coaxial cavity 620.

The PLR 1100 also includes wing elements 1140, 1142 which reinforce the coaxial cavity lock fingers when in the final lock position. The PLR also includes landing pads 1150 for the various multi pin connectors. The PLR 1100 is for the female housing 501 of the female connector 500. Therefore, these electrical connectors will be receptacles which will engagement male pins.

The PLR 1100 protects the interface seal 550 from roll over during connector assembly disengagement. The coaxial cavity 620 also has a sealing surface is formed near the first end 610 of the coaxial cavity 620. The interface seal 550 (shown in FIG. 5) further seals or completes or nearly completes a seal in the terminal end of the female housing 501. In still another embodiment, the connector apparatus has a second coaxial cavity.

Figure 14:
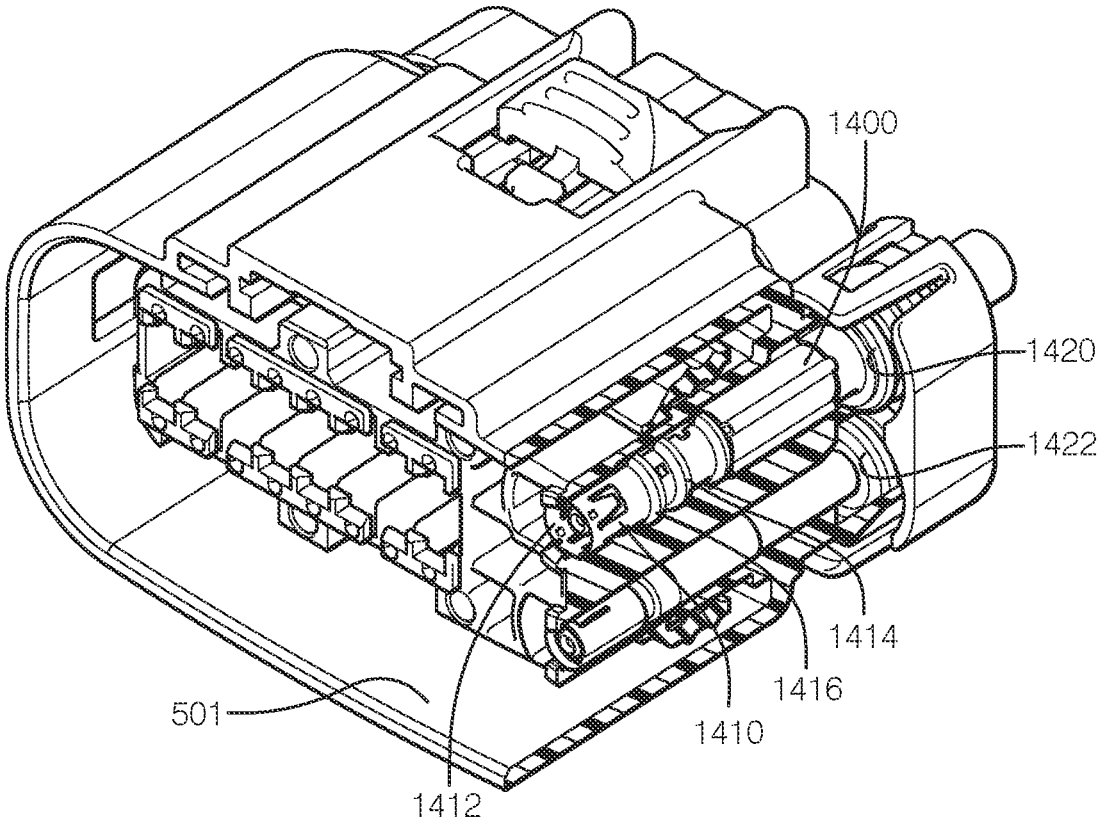
FIG. 14 is an isometric cutaway view of the housing showing the terminal end of a coaxial cable locked into a final position, according to some embodiments.
Figure 15:
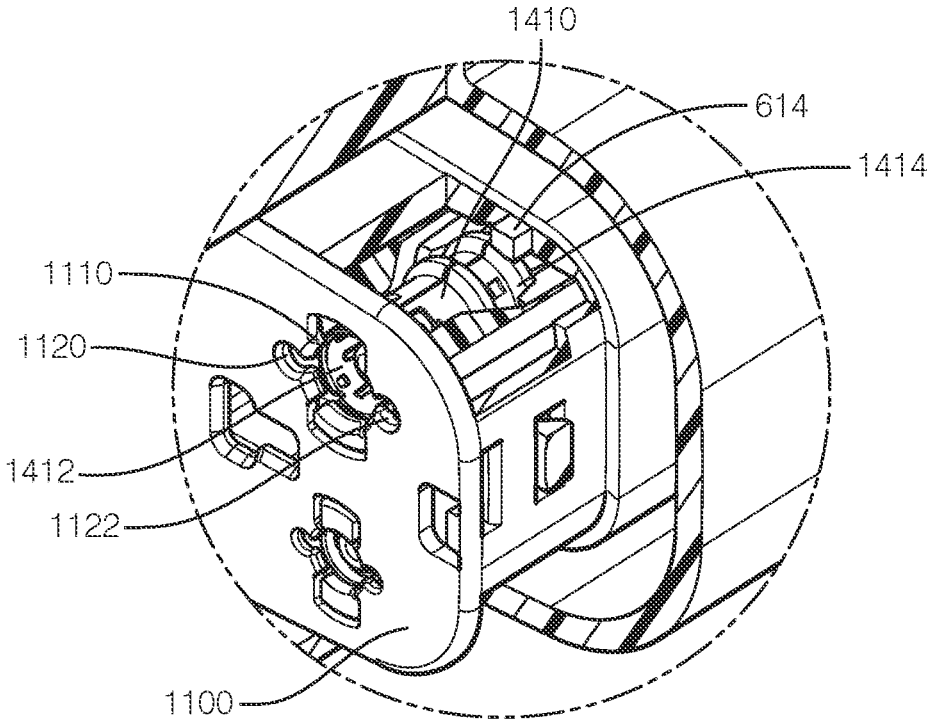
FIG. 15 is an isometric cutaway view of a coaxial cable positioned at a final stage position within the coaxial cable cavity, according to some embodiments.

FIG. 14 is an isometric cutaway view of the female housing 501 showing the terminal end of a coaxial cable locked into a final position, according to an example embodiment. FIG. 15 is an isometric cutaway view of a coaxial cable positioned at a final stage position within the coaxial cable cavity, according to an example embodiment. As discussed above, both the first locking finger 800 and the second locking finger 800 also include a locking tab, and an unlocking surface 820. The locking finger 800 is formed to be flexible and capable of flexing between a lock position and an unlock position. The locking finger biased toward the lock position. The connector assembly also includes a coaxial cable including a terminal end or coaxial terminal 1410. The terminal end of the coaxial cable includes an end 1412 that abuts the stop or stops 614, 615 at the second end 612 of the coaxial cavity 620, and a locking rib 1414, 1416 for engaging the locking tab 810 of the locking finger 800. The locking finger 800 engages one of the locking ribs 1414, 1416. The end 1412 of the coaxial cable abuts the stops 614, 615. As shown in FIGS. 14 and 15, the coaxial terminal 1410 at the end of the coaxial cable is shown locked into position with the female housing 501 FIG. 14 shows this best as the PLR 1100 has also been removed for the sake of illustration. FIG. 15 includes the PLR 1100 which blocks some of the view shown in FIG. 14. As shown in FIG. 15, the opening 1110 aligns with the coaxial terminal 1410 at the end of the cable. The primary lock reinforcement 1100, is placed in the female housing 501 and has an opening 1110 therein corresponding to the second end 612 of the cylindrical coaxial cavity 620. The unlocking surface 820 on the flexible locking finger includes an annular unlocking channel.

Figure 16:
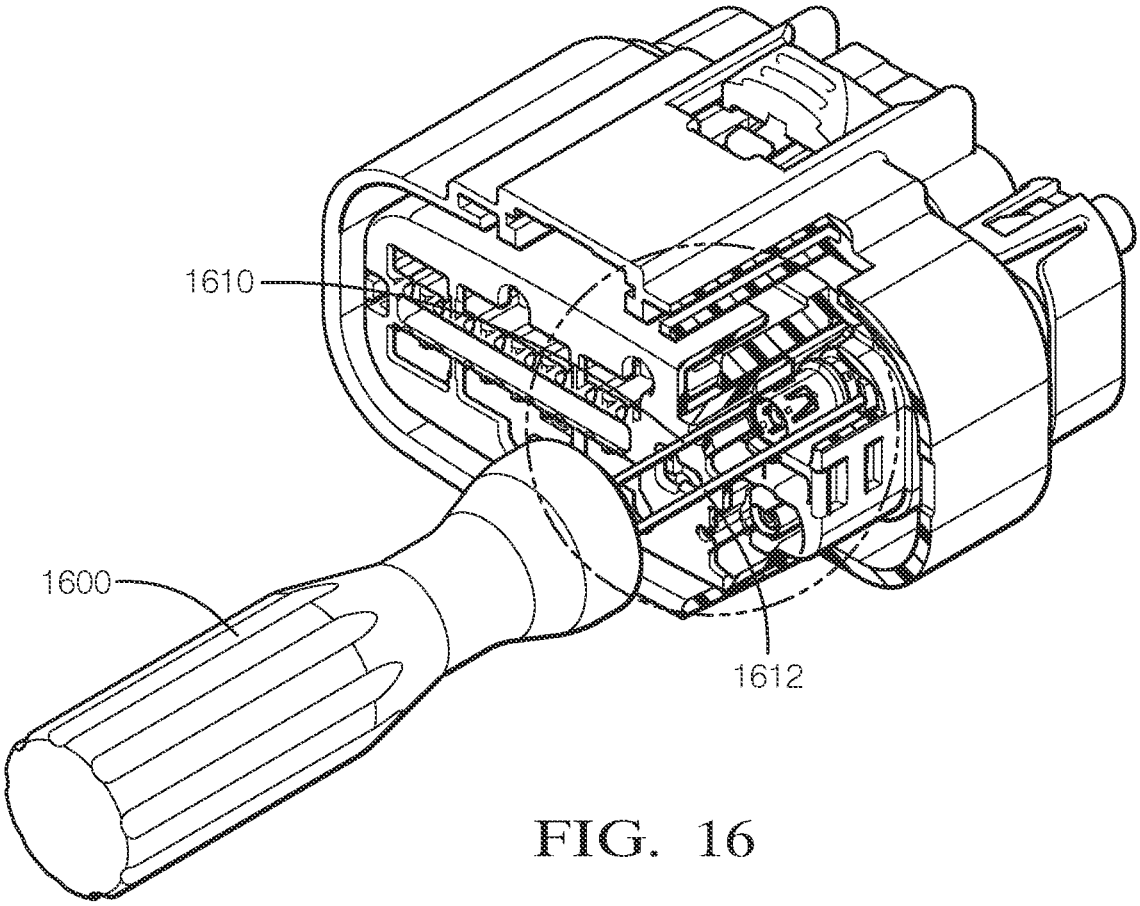
FIG. 16 is a front isometric view of a service tool unlocking the female terminal end of the cable from the housing of the female connector of the connector, according to some embodiments.
Figure 17:
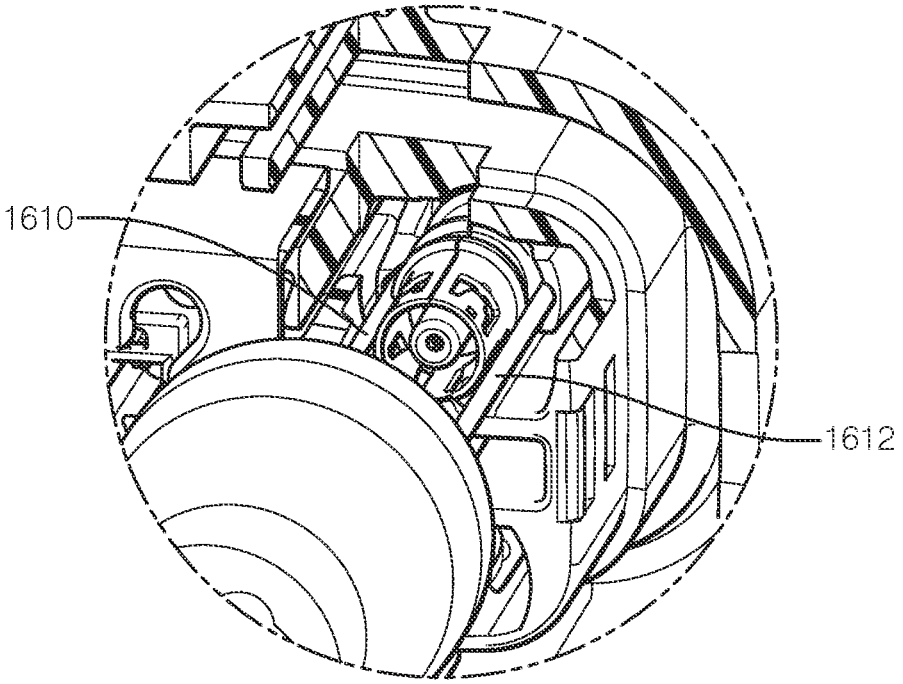
FIG. 17 is a close-up cutaway isometric view of the service tool interacting with the locking feature to unlock or release the female end of the cable from the housing, according to some embodiments.

FIG. 16 is a front isometric view of an unlocking tool 1600 unlocking the female terminal end 1410 of the cable from the female housing 501 of the female connector of the connector, according to an example embodiment. FIG. 17 is a close-up cutaway isometric view of the unlocking tool 1600 interacting with the locking feature to unlock or release the female end of the cable from the female housing 501, according to an example embodiment. The unlocking tool or unlocking tool 1600 includes an elongated first prong 1610 and an elongated second prong 1612. As shown, the coaxial terminal 1410 abuts the stop at the second end of the coaxial cavity 620, and the locking rib 1414, 1416 for engaging the locking tab of the locking finger 800. The primary lock reinforcement 1100 includes a connector side 1130, and an interior side 1131. The interior side 1131 includes annular guide channels 1120, 1122 which align to the annular unlocking surface 820. In the embodiment shown, the unlocking surface is or includes a channel in the locking tabs 810. The unlocking surface 820 is inclined toward the coax terminal from the second end of the cylindrical coaxial cavity. As shown, the coax removal tool or unlocking 1600 having a first elongated prong 1610 and a second elongated prong 1612, is inserted through the PLR 1100 along the guide channels 1120, 1122. The first prong 1610 and the second prong 1612 travel down the annular guide channel 1120, 1122 to the annular unlocking surface 820 in each of the flexible locking fingers 800 to disengage the locking tabs from the locking rib 1414 on the coax terminal which releases the coax from the cylindrical coaxial cavity 620. Each prong 1610, 1612 engages the inclined surface of the unlocking surface 820. As it travels further down the inclined unlocking surface 820 the locking finger 800 disengages from the locking rib 1414. The coaxial cable or the coaxial terminal 1410 at the end of the coaxial cable can then be removed.

Operation and Assembly

The coaxial cavity 620, in a mixed system works in such a way that when coaxial terminal 1400 (with pre-assembled wire seal 1420, 1422) inserted, the primary lock or locking finger 800 deflects and allows the coaxial terminal 1400 to move forward until it reaches a surface of the stops 614, 615. The deflected locking finger 800 will return to its original position before the terminal reaches the stop surface hence the terminal is properly locked inside the coaxial cavity. The wire seal 1420,1422 is then pushed inside the seal surface at the first end 610 of the coaxial cavity 620.

The seal retainer 546 is used to keep the wire seal 1420, 1422 in a proper position inside the coaxial cavity 620, 622. The seal retainer 546 is designed in such a way that it is inserted over the coaxial cable and the coaxial terminal 1400 with a press fit arrangement. The seal retainer 546 then slides towards the coaxial cavity 620, located and locked by the features outside the coaxial cavity at the wire exit side.

The terminal locking fingers 800 are reinforced with the features integrated with PLR 1100. The PLR 1100 features for coaxial terminal cavities are designed to be concentric to the coaxial cavity 620 and therefore align with the features of the female housing 501, as detailed above. Unlike the conventional coaxial assembly where the reinforcing features are immovable, the primary locking fingers 800 are movable inside the coaxial cavity 620 to place the reinforcing features behind the primary locks. During coaxial terminal insertion, the PLR 1100 is set at pre-stage position using lock features integrated with the female housing 501. Once all the terminals are inserted inside the housing, the PLR 1100 is pushed towards the mating direction to final stage position.

The PLR 1100 features can detect partially inserted terminals. The locking finger 800 of coaxial cavity 620, 622 stays in deflected condition if the terminal end or coaxial terminal 1410 of the coaxial cable is not properly inserted to its locked position. Hence the deflected locking finger 800 restricts the movement of PLR 1100 to its final stage or assembled position and giving indication to the operator of the partially inserted coaxial terminal 1410.

The male housing 1801 is designed with two sets of scoop tabs 1832, 1834 or pillar guides to be inserted into holes with tighter tolerances positioned on female housing 501. Since the coaxial cavities 620, 622 are positioned at corner of the connector assembly 400, the engagement force during connector to connector mating is not distributed evenly. Hence the connector tends to tilt and not travel smoothly during engagement. The first scoop tab 1832, and the second scoop tab 1834 and cavity 1132, 1134 arrangements ensure the tilting is avoided by properly locating and guiding the male connector 1800 and female connector 500. The arrangement of the cavities 1132, 1134 also locates, guides and tightly positions the male PLR 1830 with male housing 1801. This also avoids rattling of connector due to high vibration.

The coaxial cavity 620, 622 is designed with features to remove the cable and coaxial terminal 1410 out of the cavity for servicing. A concave shaped feature or unlocking surface 820 located over top of the locking finger 800 allows an unlocking tool 1600 to enter inside the coaxial cavity 620, 622. The guide channel 1120 and unlocking surface 820 guide, locate and properly position the prongs 1610, 1612 of the unlocking tool 1600 to deflect the coaxial cavity locking finger 800 to release the coaxial terminal 1410 for servicing. The coaxial PLR 1100 features also designed with a semi-circular hollow profile 1120 to locate and guide the unlocking tool 1600.

The unlocking tool 1600 is designed with two elongated prongs 1610, 1612 or actuating pins to deflect the pair of primary locking fingers 800 located in the coaxial cavities 620, 622. Advantageously, the terminal lock reinforcement function is integrated with the conventional PLR and primary lock function is combined with the housing in the inventive arrangement, so that the need for separate stuffer, and stuffer interface seal is eliminated. The solution shown and described above is unique and saves overall cost by eliminating two components from assembly bill of materials.

Discussion of Possible Embodiments

A connector apparatus including a housing, and a primary lock reinforcement. The housing may include at least one substantially cylindrical coaxial cavity therein. The coaxial cavity has a first end, a second end, and a locking finger. At least one stop may be located proximate the second end. A locking finger can be positioned intermediate the first end and the second end. The locking finger includes a locking tab, and an unlocking surface. The locking finger is formed to be flexible and capable of flexing between a lock position and an unlock position. The locking finger is biased toward the lock position. The primary lock reinforcement is placed in the housing and has an opening therein corresponding to the second end of the cylindrical coaxial cavity.

In one embodiment, the coaxial cavity includes a tubular section, and the locking finger can be formed from the sidewall of the tubular section. The tubular section may have a first pair of substantially parallel slits in the sidewall which are substantially parallel to an axis of the at least one substantially cylindrical coaxial cavity. The tubular section also may have a second pair of substantially parallel slits in the sidewall which are substantially parallel to an axis of the at least one substantially cylindrical coaxial cavity and collinear with the first pair of slits. A major portion of the locking finger can be formed between the first pair of slits and the second pair of slits. The distance between the first pair of slits and the second pair of slits in the sidewall can be a pivot area for the locking finger, in one embodiment. In another embodiment, the unlocking surface can have an unlocking channel. The unlocking channel may be inclined with respect to the outer surface of the tubular portion of coaxial cavity in the housing. The primary lock reinforcement may include a guide channel aligned with the unlocking channel on the locking finger. The primary lock reinforcement can have an opening on a connector side of the primary lock reinforcement that can correspond to the guide channel. The guide channel and the unlocking channel are sized to receive an elongated unlocking tool. In another embodiment, there can be another locking finger. In other words, there may be two locking fingers. The two locking fingers may be formed on opposite sides of the coaxial cavity. The coaxial cavity also may have a sealing surface formed near the first end of the coaxial cavity. In still another embodiment, the connector apparatus has a second coaxial cavity. In still a further embodiment, the connector apparatus may also have a plurality of elements for connecting other types of electrical contacts. The primary lock reinforcement further includes a first connector surface, and a second interior surface which can include an alignment scoop to engage corresponding features in the housing. In one embodiment the connector is a female connector, and in another embodiment the connector is a male connector.

A connector assembly may include a housing having at least one substantially cylindrical coaxial cavity therein. The coaxial cavity can also include a first end, and a second end. The cylindrical coaxial cavity may have at least one stop located proximate the second end. The cylindrical coaxial cavity also can have a first locking finger intermediate the first end and the second end, and can have a second locking finger intermediate the first end and the second end. The second locking finger may be situated on the opposite side of the coaxial cavity from the first locking finger. Both the first locking finger and the second locking finger also may have a locking tab, and an unlocking surface. The locking finger may be formed to be flexible and capable of flexing between a lock position and an unlock position. The locking finger can be biased toward the lock position. The connector assembly also includes a coaxial cable including a terminal end. The terminal end can include an end that abuts the stop at the second end of the coaxial cavity and can include a locking rib for engaging the locking tab of the locking finger. The connector assembly also can include a primary lock reinforcement, which is placed in the housing. The primary lock reinforcement has an opening therein corresponding to the second end of the cylindrical coaxial cavity. The unlocking surface on the flexible locking finger may include an annular unlocking channel. The primary lock reinforcement may have a connector side, and an interior side. The interior side can include annular guide channels which align to the annular unlocking channel on the locking tab. The unlocking channel may be inclined toward the coax terminal from the second end of the cylindrical coaxial cavity. The connector assembly can also include a coax removal tool having a first elongated prong and a second elongated prong. The connector side can include a first opening for the first annular guide channel, and a second opening for the second annular guide channel. The first prong and the second prong are inserted each prong travels down the annular guide channel to the annular unlocking channel in each of the flexible locking fingers to disengage the locking tabs from the locking rib on the coax terminal to release the coax from the cylindrical coaxial cavity.

It should be noted that the above specification is an example embodiment and that other embodiments are contemplated. For example, the invention is not limited to a connector assembly which has multiple pin portion as well as to coaxial portions. The housing could be adapted to only handle coaxial cables or just a single coaxial cable. The cylindrical coaxial cavity 620 could also be modified. All the above are contemplated as being within the scope of the invention and being within the scope of the appended claims.

The foregoing description of the specific embodiments reveals the general nature of the invention sufficiently that others can, by applying current knowledge, readily modify and/or adopt for various applications without departing from the concept, and therefore such a do adaptations and modifications are intended to be to be comprehended within the meaning and range of equivalents of the disclosed embodiments.

It is also to be understood that the phraseology or terminology employed herein is for the purpose of description and not of limitation. Accordingly, the invention is intended to embrace all such alternatives, modifications, equivalents and variations as fall within the spirit and broad scope of the appended claims.

The invention claimed is:

1. A connector apparatus comprising:

a housing having at least one substantially cylindrical cavity therein, the cavity further comprising:
- a first end; and
- a second end;

a locking finger intermediate the first end and the second end within the substantially cylindrical cavity, the locking finger comprising:
- a locking tab; and
- an unlocking surface, the locking finger formed to be flexible and capable of flexing between a lock position and an unlock position, the locking finger biased toward the lock position, the unlocking surface configured to deflect the locking finger to the unlock position;

a primary lock reinforcement element, which is placed in the housing, the primary lock reinforcement element further comprising:
- a connector side and an interior side;
- an opening therein corresponding to the second end of the cylindrical cavity; and
- an annular guide channel extending from an opening on the connector side to an opening on the interior side, wherein the annular guide channel is aligned with the unlocking surface of the locking finger.

2. The connector apparatus of claim 1, wherein the unlocking surface includes an unlocking channel, the unlocking channel configured to receive an unlocking tool to deflect the locking finger to the unlock position, wherein the unlocking tool is guided to the unlocking channel via the annular guide channel.

3. The connector apparatus of claim 2, wherein the unlocking channel is aligned with the annular guide channel on the primary lock reinforcement element.

4. The connector apparatus of claim 1, where the cylindrical cavity includes a tubular section, the locking finger formed from a sidewall of the tubular section.

5. The connector apparatus of claim 4, wherein the locking finger includes a free end that moves between the lock position and the unlock position, wherein the lock position is toward a central axis of the cylindrical cavity.

6. The connector apparatus of claim 5, wherein the unlocking surface includes an unlocking channel, where the unlocking channel is inclined with respect to an outer surface of the tubular section of cylindrical cavity in the housing.

7. The connector apparatus of claim 6, wherein the unlocking channel is most distant from the central axis of the cylindrical cavity near the second end.

8. The connector apparatus of claim 4, wherein the tubular section further comprises:

a first pair of substantially parallel slits in the sidewall which are substantially parallel to a central axis of the at least one substantially cylindrical cavity; and a second pair of substantially parallel slits in the sidewall which are substantially parallel to the axis of the at least one substantially cylindrical cavity and collinear with the first pair of slits, a major portion of the locking finger formed between the first pair of slits and the second pair of slits.

9. The connector apparatus of claim 8, wherein the locking finger rotates between the lock position and the unlock position about a pivot area defined between the first pair of substantially parallel slits and the second pair of substantially parallel slits.

10. The connector apparatus of claim 1 wherein the primary lock reinforcement element further includes:

a first connector surface; and a second interior surface which includes an alignment scoop to engage corresponding features in the housing.

11. A connector assembly comprising:

a housing having at least one substantially cylindrical cavity therein, the cylindrical cavity further comprising:

a first end;

a second end, at least one stop located proximate the second end;

a first locking finger intermediate the first end and the second end; and a second locking finger intermediate the first end and the second end, the second locking finger on an opposite side of the cylindrical cavity, both the first locking finger and the second locking finger further comprising:

a locking tab; and an unlocking surface, the locking finger formed to be flexible and capable of flexing between a lock position and an unlock position, the locking finger biased toward the lock position, the unlocking surface configured to deflect the locking finger to the unlock position;

a cable including a terminal end further comprising:

an end that abuts the stop at the second end of the cylindrical cavity; and a locking rib for engaging the locking tab of the locking finger; and a primary lock reinforcement element, which is placed in the housing, the primary lock reinforcement element further comprising:

a connector side and an interior side;

an opening therein corresponding to the second end of the cylindrical cavity; and annular guide channels extending from an opening on the connector side to an opening on the interior side, the annular guide channels aligned with the unlocking surfaces associated with the first and second locking fingers.

12. The connector assembly of claim 11, wherein the unlocking surfaces include an unlocking channel, wherein the unlocking channel is inclined with respect to a sidewall of the substantially cylindrical cavity.

13. The connector assembly of claim 12, wherein the unlocking channels are aligned with the annular guide channels on the primary lock reinforcement element.

14. The connector assembly of claim 11, where the cylindrical cavity includes a tubular section, the first locking finger and the second locking finger formed from a sidewall of the tubular section.

15. The connector assembly of claim 14, wherein the first and second locking fingers include a free end that moves between the lock position and the unlock position, wherein the lock position is toward a central axis of the cylindrical cavity.

16. The connector assembly of claim 15, wherein the unlocking surfaces include an unlocking channel, where the unlocking channel is inclined with respect to an outer surface of the tubular section of cylindrical cavity in the housing.

17. The connector assembly of claim 16, wherein the unlocking channels are most distant from the central axis of the cylindrical cavity near the second end of the housing.

18. The connector assembly of claim 14, wherein the tubular section further comprises with respect to both the first locking finger and the second locking finger:

a first pair of substantially parallel slits in the sidewall which are substantially parallel to a central axis of the at least one substantially cylindrical cavity; and a second pair of substantially parallel slits in the sidewall which are substantially parallel to the axis of the at least one substantially cylindrical cavity and collinear with the first pair of slits, a major portion of the respective locking finger formed between the first pair of slits and the second pair of slits.

19. The connector assembly of claim 18, wherein both the first locking finger and the second locking finger rotate between the lock position and the unlock position about a pivot area defined between the respective first pair of substantially parallel slits and the respective second pair of substantially parallel slits.

20. The connector assembly of claim 11 further comprising:

a removal tool having a first elongated prong and a second elongated prong configured to be inserted within the annular guide channels aligned with the unlocking surfaces associated with the first and second locking fingers, wherein as the first prong and the second prong are inserted each prong travels down the annular guide channels to the unlocking surfaces associated with the first locking finger and the second locking finger, respectively, causing the locking tabs to disengage the locking rib from the terminal end to release the cable from the cylindrical cavity.

* * * * *